US005100176A

United States Patent [19]

Ball et al.

[11] Patent Number: 5,100,176

[45] Date of Patent: Mar. 31, 1992

[54] TONGUE ASSEMBLY

[75] Inventors: Keith R. Ball, New Baltimore, Mich.; Phillip H. McCune, Mt. Clemens, Mich.

[73] Assignee: TRW Vehicle Safety Systems Inc., Lyndhurst, Ohio

[21] Appl. No.: 698,605

[22] Filed: May 10, 1991

[51] Int. Cl.[5] ..... B60R 22/00

[52] U.S. Cl. ..... 280/801; 24/196; 24/171; 297/476

[58] Field of Search ..... 280/801, 808, 806, 807; 247/483, 468, 476, 479; 24/196, 171, 68 CD, 635

[56] References Cited

U.S. PATENT DOCUMENTS 4,163,530 8/1979 Kondo et al. ..... 280/808
4,480,854 11/1984 Doty ..... 280/801
4,558,887 12/1985 Doty ..... 280/802
4,588,207 5/1986 Doty ..... 280/801
4,762,338 8/1988 Hayden ..... 280/801
4,893,874 1/1990 Childress et al. ..... 297/483
4,903,377 2/1990 Doty ..... 24/194
4,979,764 12/1990 Drinane et al. ..... 280/808

*Primary Examiner*—Charles A. Marmor
*Assistant Examiner*—Paul Dickson
*Attorney, Agent, or Firm*—Tarolli, Sundheim & Covell

[57] ABSTRACT

A tongue assembly for use in a safety apparatus in which belt webbing restrains movement of an occupant of a vehicle includes a base, a cover, and a cam. The cover is mounted for sliding movement on the base. The cover has an actuator portion engageable by the belt webbing to slide the cover along the base between a first portion and a second position. The cover engages and pivots a cam when the cover slides from its first position to its second position. The cam has a clamping surface disposed adjacent a clamping surface on the base. A portion of the belt webbing passes between the clamping surfaces on the base and the cam member. The cam is pivoted by sliding movement of the base into a clamping position in which the cam clamps the belt webbing against the base to block movement of the belt webbing through the tongue assembly.

15 Claims, 4 Drawing Sheets

TONGUE ASSEMBLY

BACKGROUND OF THE INVENTION

1. Technical Field

The present invention relates to a tongue assembly for use in a vehicle seat belt system for restraining movement of an occupant of a vehicle.

2. Description of the Prior Art

A known vehicle seat belt system is a three-point continuous loop seat belt system. A three-point continuous loop seat belt system includes a seat belt retractor and a length of belt webbing. The belt webbing extends from the retractor through a D-ring fixed to the vehicle and then down to an anchor point near the vehicle floor A tongue assembly is slidable along the length of belt webbing between the D-ring and the anchor point. To use the seat belt system, a vehicle occupant grasps the tongue assembly and insert it into a buckle When the tongue assembly is fastened in the buckle, a portion of the belt webbing extends across the lap of the vehicle occupant and a portion of the belt webbing extends diagonally across the torso of the vehicle occupant.

When the tongue assembly is released from the buckle, the belt webbing is wound onto the retractor. As the retractor winds the belt webbing, the tongue assembly may be moved along with the belt webbing. The tongue assembly may engage the D-ring before the belt webbing is completely stowed on the retractor. If the belt webbing can not be pulled freely through the tongue assembly when the tongue assembly engages the D-ring, belt retraction stops, and some belt webbing is left loose and unretracted.

Accordingly, it is desirable for a tongue assembly to clamp the belt webbing securely when the tongue assembly is inserted into the buckle, and to allow the belt webbing to run freely through the tongue assembly when the tongue assembly is adjacent a D-ring.

SUMMARY OF THE INVENTION

The present invention is a tongue assembly for use in a seat belt system in which belt webbing restrains movement of an occupant of a vehicle or of a child seat in a vehicle. The tongue assembly includes a base, a cover, and a clamping member. The base has a latching portion for engagement with a buckle and an opening through which the belt webbing extends. The cover is mounted for movement on the base. The cover has an actuator portion engaged by the belt webbing upon tensioning of the belt webbing to move the cover on the base between a first position and a second position.

The clamping member is also mounted for movement on the base. The clamping member has a first clamping surface disposed adjacent a second clamping surface on the base. The belt webbing passes between the first clamping surface on the base and the second clamping surface on the clamping member. The clamping member is movable into a clamping position in which the first clamping surface on the clamping member clamps the belt webbing against the second clamping surface on the base to block movement of the belt webbing through the tongue assembly. The cover has means for moving the clamping member into its clamping position to clamp the belt webbing when the cover moves from its first position to its second position.

In a preferred embodiment of the invention, the cover is mounted for sliding movement on the base. The clamping member is a cam mounted for pivotal movement on the base. Sliding movement of the cover from its first position to its second position pivots the cam into its clamping position.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF PREFERRED EMBODIMENT OF THE INVENTION

Figure 1:
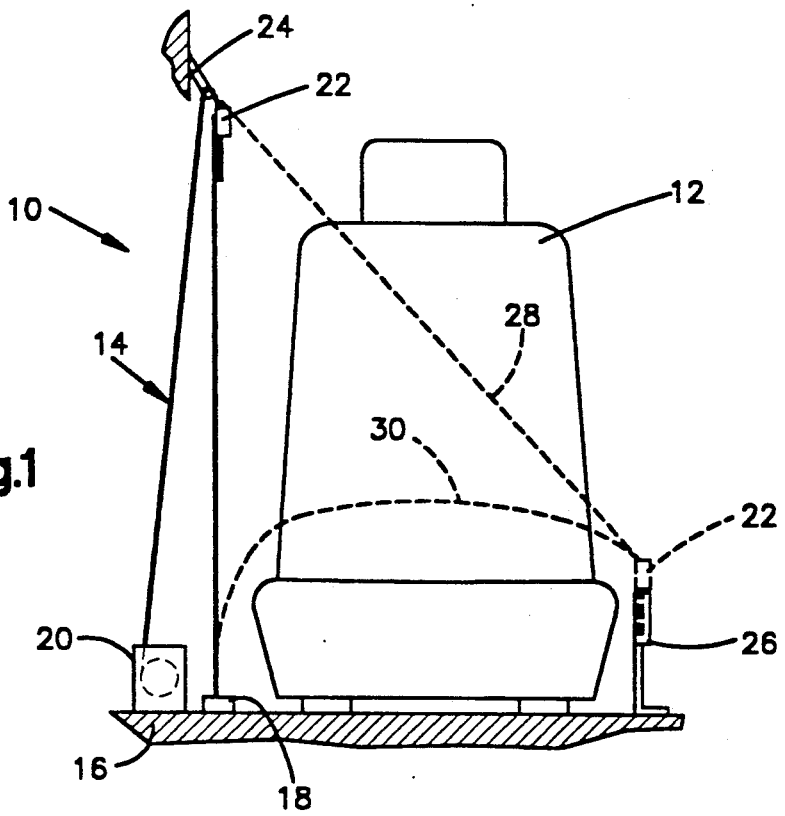
FIG. 1 is a schematic illustration of a vehicle seat belt system having a tongue assembly in accordance with the present invention.

The present invention is illustrated in FIG. 1 as applied to a three-point continuous loop seat belt system 10 for use in restraining an occupant of a vehicle or a child seat against movement relative to the vehicle. The following description assumes that the seat belt system 10 is used in restraining a vehicle occupant. It should be understood that the invention could be applied to other belt systems.

During operation of the vehicle, an occupant of the vehicle sits on a seat 12 which is illustrated as a front passenger seat in the vehicle. A length of belt webbing 14 is extendible about the vehicle occupant. One end of the length of belt webbing 14 is anchored to the vehicle body 16 at an anchor point 18. The opposite end of the belt webbing 14 is attached to a retractor 20 secured to the vehicle body. Intermediate its ends, the belt webbing 14 passes through a tongue assembly 22 and a D-ring 24. When the seat belt system 10 is not in use, the belt webbing 14 is wound on the retractor 20 and is oriented generally vertically on one side of the seat 12, as shown in solid lines in FIG. 1.

To engage the seat belt system 10, the tongue assembly 22 is manually grasped and is pulled across the lap and torso of the occupant sitting in the seat 12. As the tongue assembly 22 is pulled across the lap and torso of the occupant, the tongue assembly moves along the belt webbing 14, and the belt webbing 14 is unwound from the retractor 20. When the belt webbing 14 has been pulled across the lap and torso of the occupant, the tongue assembly 22 is connected with a buckle 26, as shown in dashed lines in FIG. 1. The buckle 26 is connected to the vehicle body 16 and is disposed on a side of the seat 12 opposite the anchor point 18. When the seat belt system 10 is thus buckled, the length of belt webbing 14 is divided by the tongue assembly into a torso portion 28 which extends across the torso of the occupant and a lap portion 30 which extends across the lap of the occupant.

Figure 2:
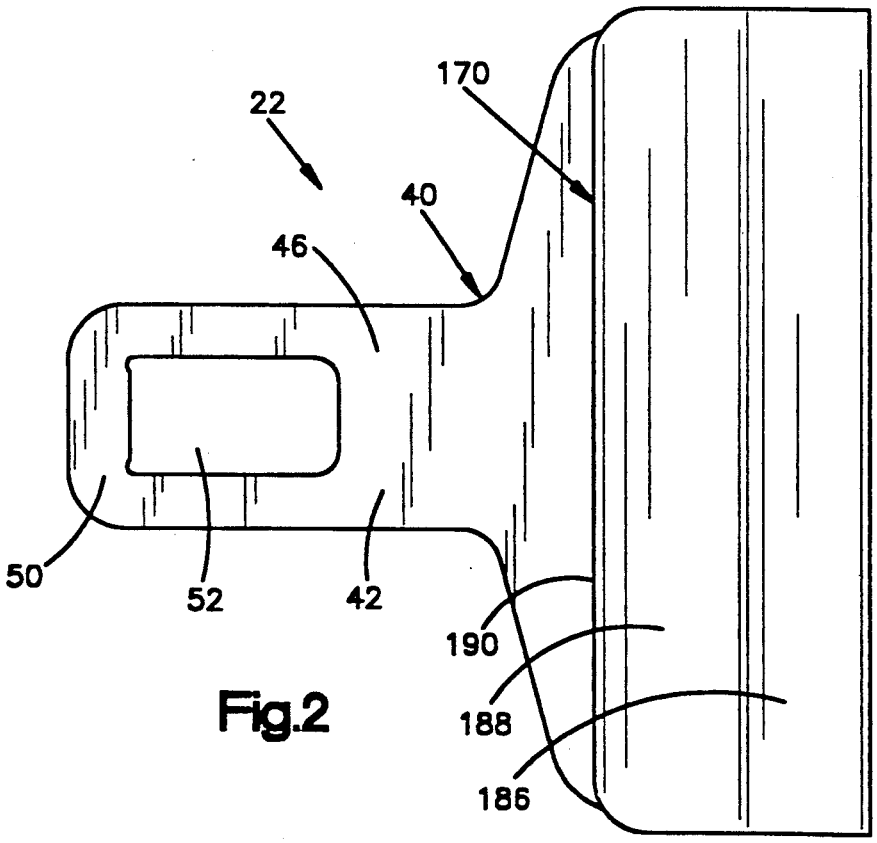
FIG. 2 is a top plan view of the tongue assembly of FIG. 1.
Figure 3:
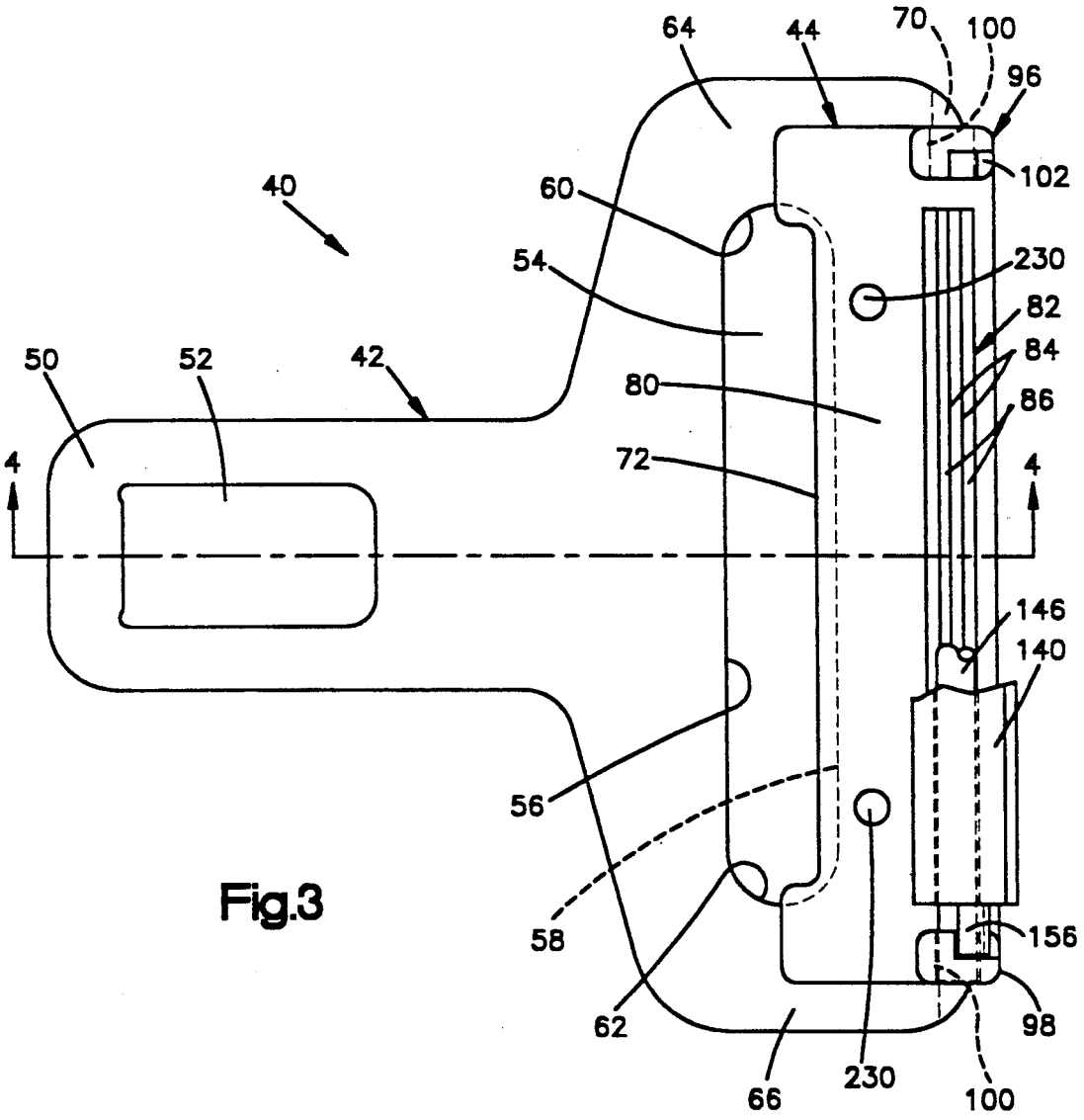
FIG. 3 is a top plan view of the tongue assembly of FIG. 2 with parts removed.
Figure 4:
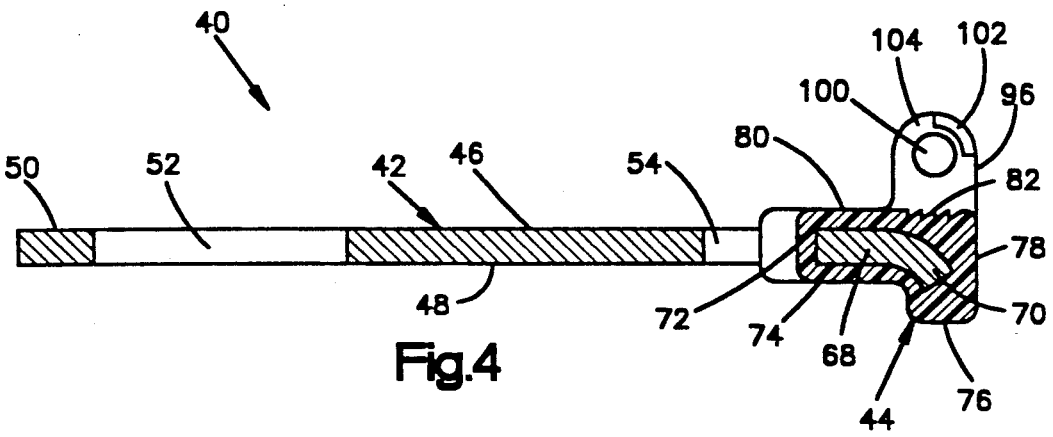
FIG. 4 is a sectional view taken along line 4—4 of FIG. 3.
Figure 5:
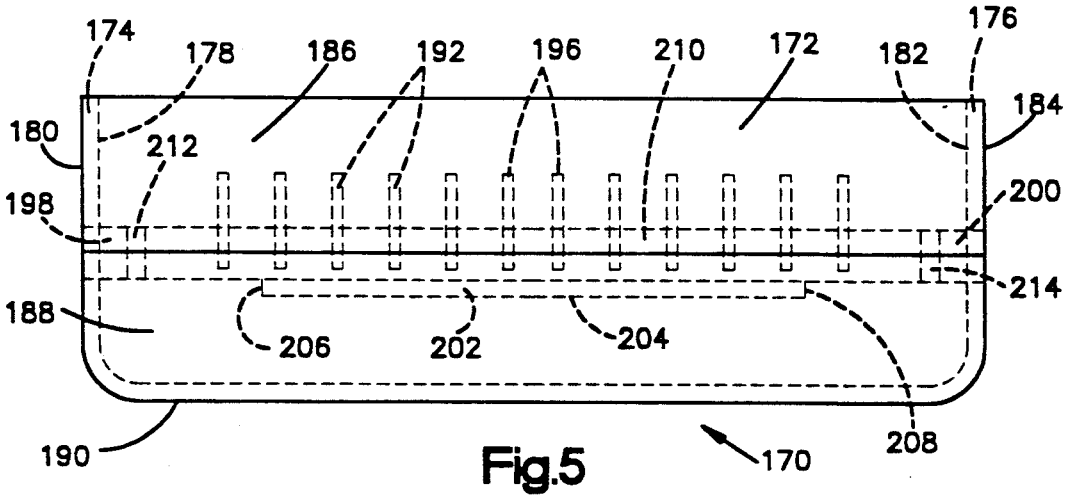
FIG. 5 is a top plan view of a part of the tongue assembly of FIG. 2 showing portions thereof in dotted lines.

The tongue assembly 22 includes a base 40 (FIGS. 2–4). The base 40 includes a metal latch plate 42 and a plastic body 44 molded on the latch plate 42. The latch plate 42 is a generally planar piece of metal having an upper major side surface 46 and a lower major side surface 48. The latch plate 42 includes a latching portion 50 through which extends a latching opening 52 for receiving a portion of the buckle 26. The latch plate 42 is preferably made from AISI 4130 steel which is heat treated and chrome plated.

A webbing opening 54 extends through the latch plate 52 between the upper major side surface 46 and the lower major side surface 48. The webbing opening 54 is defined by a straight leading edge 56, a straight trailing edge 58, and two curved side edges 60 and 62. The side edges 60 and 62 are spaced apart far enough to allow the belt webbing 14 to pass freely through the webbing opening 54. Two connector portions 64 and 66 of the latch plate 52 are located on opposite sides of the webbing opening 54. A trailing end portion 68 is located at the opposite end of the latch plate 42 from the latching portion 50. The end 70 of the trailing end portion 68 of the latch plate 42 is bent out of the plane of the latch plate 42, as seen in FIG. 4.

The plastic body 44 of the base 40 is molded around the trailing end portion 68 of the latch plate 42. The plastic body 44 is preferably molded from ZYTEL (a trademark of E.I. DuPont de Nemours & Co.) brand plastic. The plastic body 44 extends onto the connector portions 64 and 66 of the latch plate 42. In cross-sectional configuration, as seen in FIG. 4, the plastic body 44 has a leading end surface 72, a lower side surface 74, a bottom surface 76, a trailing end surface 78, and a first clamping surface 80. The leading end surface 72 extends transverse to the plane of the latch plate 42 and extends through the webbing opening 54.

The first clamping surface 80 on the base 40 extends parallel to the plane of the latch plate 42. The first clamping surface 80 includes a series of teeth 82 (see FIGS. 4 and 9A) formed by the plastic material of the plastic body 44. Each tooth 82 is defined by a surface 84 normal to the plane of the first clamping surface 80 and a surface 86 inclined at an angle to the plane of the surface 80. The inclined surfaces 86 extend at an angle of less than 90° to the normal surfaces 84, preferably an angle of about 66°. The inclined surfaces 86 form, with the normal surfaces 84, a series of crests 88 (best seen in FIG. 9) which extend transversely across the belt webbing 14.

The plastic body 44 of the base 40 includes two cam support posts 96 and 98 located at opposite sides of the plastic body 44. The posts 96 and 98 extend perpendicularly to the first clamping surface 80. A circular opening 100 extends through the post 96. A guideway 102 is formed on the inner face 104 of the post 96 facing the post 98. The guideway 102 is partially defined by an arcuate surface 106 extending circumferentially 90° between two stop surfaces 108 and 110. The post 98 is formed as a mirror image of the post 96 and has a similar opening 100 and guideway 102.

A cam 140 (FIGS. 3 and 9) is mounted for rotation on the base 40 about an axis 142. A circular central opening 144 extends axially through the cam 140. A pin 146 extends through the opening 144 in the cam 140. The ends of the pin 146 are press fit in the openings 100 in the posts 96 and 98. The cam 140 is rotatable on the pin 146. The cam 140 is preferably made from an acetal resin such as DELRIN (a trademark of E. I. DuPont de Nemours & Co.) brand resin.

Figure 9A:
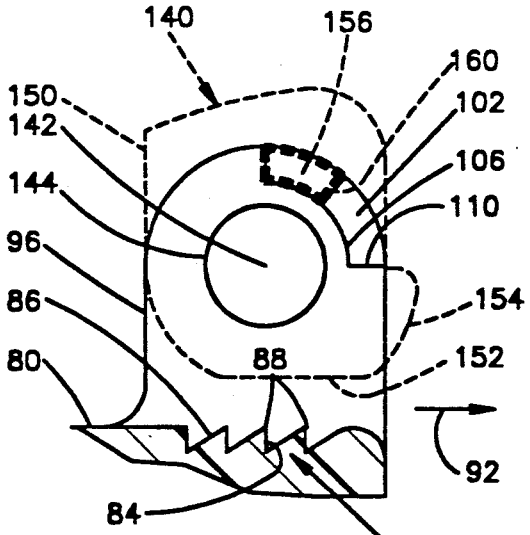
FIGS. 9A and 9B are schematic views illustrating parts of the tongue assembly in different positions.
Figure 9B:
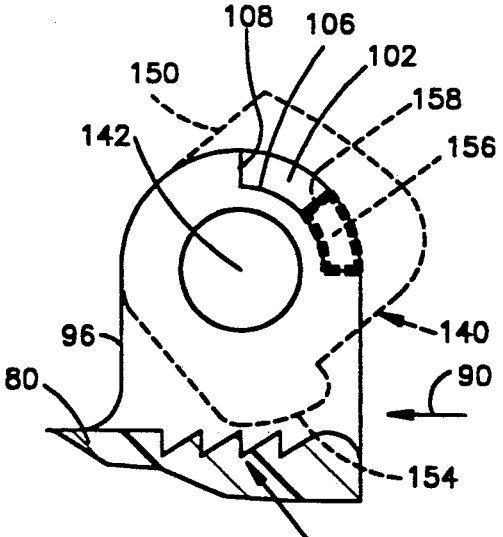

The cam 140 has a leading surface 150 which, when the tongue assembly 22 is in the unlocked condition shown in FIG. 9A, extends generally perpendicular to the first clamping surface 80 of the base 40. The cam 140 has a flat clearance surface 152 which, when the tongue assembly is in the unlocked condition shown in FIG. 9A, extends generally parallel to the first clamping surface 80 of the base 40. The cam 140 also has a curved second clamping surface 154 preferably formed in the shape of an involute curve. The radial distance between the axis 142 and the second clamping surface 154 is greater than the radial distance between the axis 142 and the clearance surface 152.

A pair of projections 156 extend axially outwardly from opposite ends of the cam 140. The projections 156 are received in the guideways 102 in the posts 96 and 98. Each projection 156 extends circumferentially around the axis 142 of the cam 140 between a radially extending first end surface 158 and a radially extending second end surface 160. The end surface 158 is engageable with the stop surface 108 of the guideway 102 to limit rotation of the cam 140 in a counterclockwise direction as viewed in FIG. 9A. The end surface 160 of the projection 156 is engageable with the stop surface 110 of the guideway 102, to limit rotation of the cam 140 in a clockwise direction as viewed in FIG. 9B.

The projections 156 on the cam 140 extend circumferentially for about 40° between the end surfaces 158 and 160 on the projection 156. The guideways 102 on the posts 96 and 98 extend circumferentially for about 90° between the surfaces 108 and 110. Accordingly, the projections 156 have a range of movement of about 50° in the guideways 102. Thus, the cam 140 has a range of rotational movement of about 50° about the axis 142.

A movable member, which in the preferred embodiment is a cover 170, is mounted for sliding movement on the base 40. The cover 170 includes a top wall 172 extending between two side walls 174 and 176. The side wall 174 has an inner wall surface 178 and an outer wall surface 180. The side wall 176 has an inner wall surface 182 and an outer wall surface 184. The top wall 172 includes an upper portion 186 (FIG. 7) extending generally parallel to the plane of the latch plate 42. A portion 188 of the top wall 172 extends at an angle between the upper potion 186 and a front portion 190.

A series of ribs 192 are molded with the cover 170 and depend from an inner surface 194 of the top wall 172. The ribs 192 extend parallel to the side walls 174 and 176 of the cover 170. Each rib 192 terminates in an end surface 196 facing the cam 140 and extending perpendicular to the first clamping surface 80.

On one side of the cover 170, a tab 198 projects inwardly from the inner wall surface 178 of the side wall 174. Similarly, on the other side of the cover 170, a tab 200 projects inwardly from the inner wall surface 184 of the side wall 176.

Figure 8:
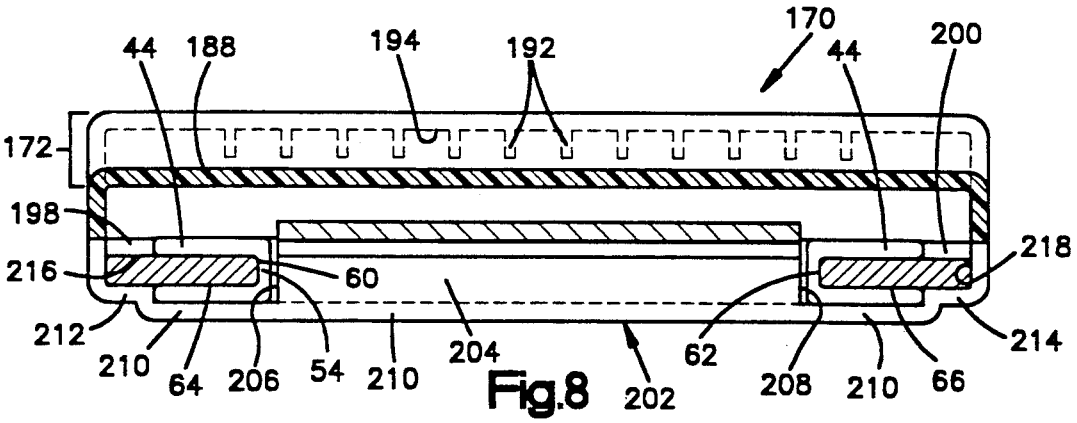
FIG. 8 is a sectional view taken along line 8—8 of FIG. 6, with parts removed.

The cover 170 includes an actuator 202. The actuator 202 extends generally perpendicular to the plane of the latch plate 42 and parallel to the axial extent of the cam 140. The actuator 202 has a flat front surface 204 which extends between opposite end surfaces 206 and 208 and which faces toward the latching portion 50 of the base 40. The actuator 202 is supported by a support web 210 depending, at its ends, from guide portions 212 and 214 fixed to the cover side walls 174 and 176, respectively. The actuator 202 extends upwardly, as viewed in FIG. 8, from the support web 210 into the webbing opening 54, between the connector portions 64 and 66 of the latch plate 42. The actuator 202, the actuator support web 210, and the guide portions 212 and 214 are all preferably molded as one piece with, and as a part of, the cover 170.

The tab 198 (FIG. 8) and the guide portion 212 of the cover 170 define between them a slot 216. The connector portion 64 of the latch plate 42 of the base 40 is received in the slot 216. On the opposite side of the cover 170, the tab 200 and the guide portion 214 define between them a slot 218. The connector portion 66 of the latch plate 42 of the base 40 is received in the slot 218. The cover 170 is slidable along the connector portions 64 and 66 of the latch plate 42. Thus, the cover 170 and the actuator 202 are supported for sliding movement along the base 40.

Figure 6:
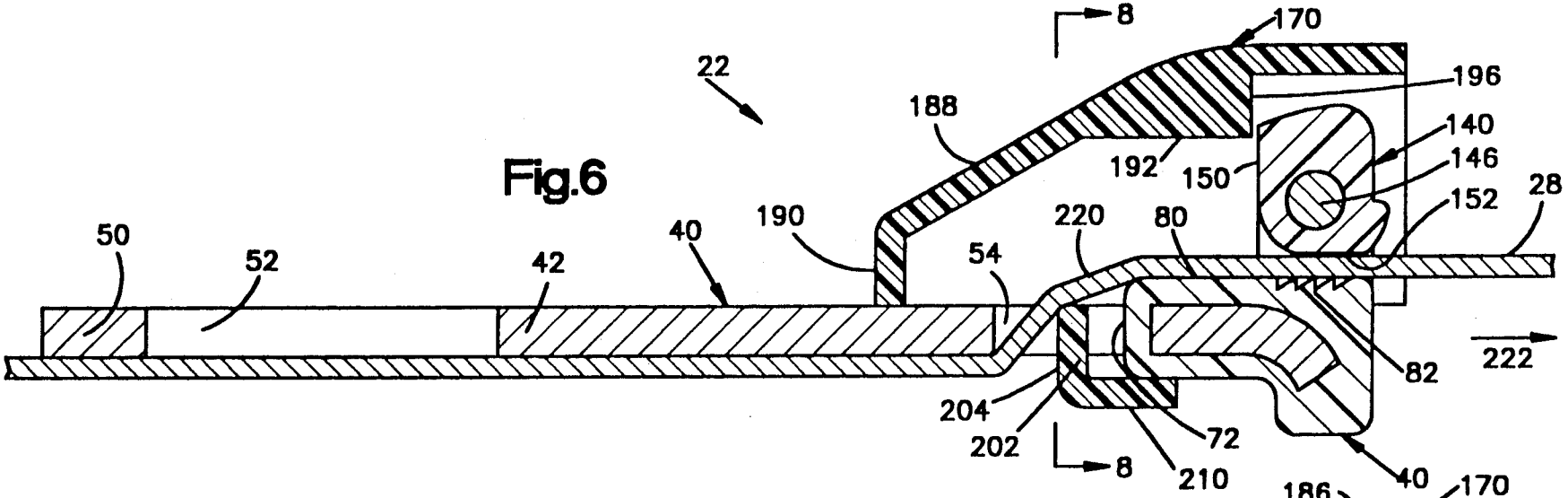
FIG. 6 is a longitudinal sectional view of the tongue assembly of FIG. 1, showing parts thereof in one condition.

FIGS. 6 and 9A illustrate the parts of the tongue assembly 22 in an unlocked condition. This is the condition of the tongue assembly when, for example, the belt webbing 14 of the safety apparatus 10 (FIG. 1) is stowed and the tongue assembly 22 is adjacent the D-ring 24. In this unlocked condition, the cover 170 (FIG. 6) is disposed on the base 40 in a first position as viewed in FIG. 6. The actuator 202 is also disposed on the base 40 in a first position as viewed in FIG. 6. The actuator 202 is spaced from the leading side surface 72 of the plastic body 44 of the base 40.

In the unlocked condition, the belt webbing 14 extends through the tongue assembly 22 in a relatively straight condition. The lap portion 30 of the belt webbing 14 extends parallel to and along the latching portion 50 of the base 40. A portion 220 of the belt webbing 14 extends through the webbing opening 54 in the base 40.

In the unlocked condition, the cam 140 is positioned as viewed in FIG. 6. The clearance surface 152 on the cam 140 is parallel to and faces the first clamping surface 80 on the base 40. The belt webbing 14 passes between the clearance surface 152 on the cam 140 and the first clamping surface 80 on the base 40. There is sufficient distance between the clearance surface 152 on the cam 140 and the first clamping surface 80 on the base 40 so that the belt webbing 14 can run relatively freely between the cam 140 and the clamping surface 80. The inclined surfaces 86 of the teeth 82 are oriented so that the teeth 82 with their crests 88 do not significantly resist movement of the belt webbing 14 through the tongue assembly 22 in a direction as indicated by the arrow 222 in FIG. 6.

The vehicle occupant buckles the safety apparatus 10 by engaging the latching portion 50 of the tongue assembly 22 with the buckle 26. The vehicle occupant pulls on the torso portion 28 of the belt webbing 14 until enough belt webbing passes through the tongue assembly 22 to make the lap portion 30 fit tightly around the occupant's lap. The vehicle occupant then releases the torso portion 28 of the belt webbing 14. The safety apparatus 10 is then in the buckled condition as shown in dotted lines in FIG. 1. The tongue assembly is in the locked condition shown in FIGS. 7 and 9B.

Figure 7:
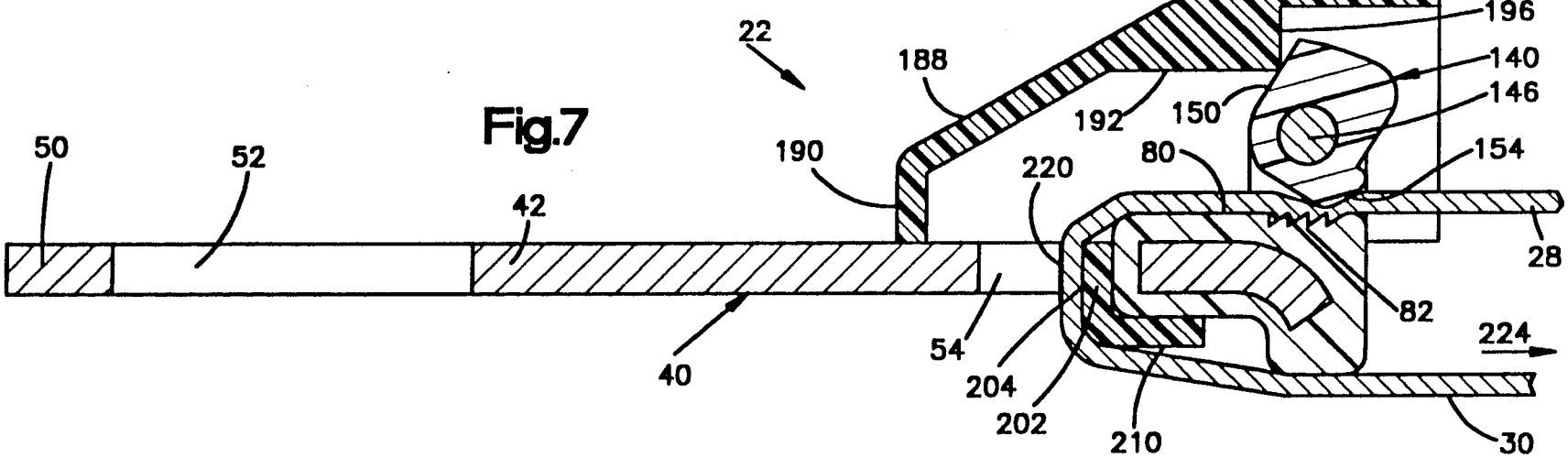
FIG. 7 is a view similar to FIG. 6, but showing the parts in another condition.

When the tongue assembly is in the locked condition, the belt webbing 14 assumes a U-shape within the tongue assembly 22, as seen in FIG. 7. Both the lap portion 30 and the torso portion 28 of the belt webbing 14 extend from the trailing end of the tongue assembly 22 opposite the latching portion 50. The lap portion 30 of the belt webbing 14 is tight around the occupant's lap and is therefore under tension. This tensile force acts on the lap portion 30 of the belt webbing 14 in the direction indicated by the arrow 224 in FIG. 7. The torso portion 28 of the belt webbing 14 is also under tension from retraction force applied by the retractor 20. These forces are transmitted to the portion 220 of the belt webbing 14 which extends through the webbing opening 54 in the base 40.

The force on the belt webbing portion 220 causes the belt webbing to move the actuator 202 from its first position as shown in FIG. 6 to its second position as shown in FIG. 7. The webbing portion 220 engages the front surface 204 of the actuator 202 and moves the actuator 202 in a direction as indicated by the arrow 224 in FIG. 7. The actuator 202 slides in that direction until it engages the leading side surface 72 on the plastic body 44 of the base 40. Further sliding movement of the actuator 202 in the direction indicated by the arrow 224 is then blocked The actuator 202 is molded with and a part of the cover 170. Thus, as the actuator 202 moves relative to the base 40 in the direction indicated by the arrow 224, the other portions of the cover 170 also move in that direction from the first position shown in FIG. 6 to the second position shown in FIG. 7. When the cover 170 moves sufficiently in that direction, the end surfaces 196 on the ribs 192 engage the leading surface 150 on the cam 140.

The cam 140 is rotated in a clockwise direction, as viewed in FIGS. 6 and 7, from the position shown in FIG. 6 to the position shown in FIG. 7. The second clamping surface 154 is rotated into a position facing the first clamping surface 80. The radial distance between the cam axis 142 and the second clamping surface 154 is large enough so that the second clamping surface 154 on the cam 140 engages the torso portion 28 of the belt webbing 14 and clamps it against the first clamping surface 80.

The inclined surfaces 86 on the teeth 82 are oriented such that the teeth 82 engage the belt webbing 14 and block movement of the belt webbing 14 through the tongue assembly 22 in the direction indicated by the arrow 224 in FIG. 7. Thus, the belt webbing 14 is securely clamped in the tongue assembly 22, and the lap portion 30 of the belt webbing 14 cannot be lengthened.

If the force applied to the lap portion 30 of the belt webbing 14 is increased, as may happen if the vehicle decelerates suddenly and the vehicle occupant is thrown forward relative to the seat 12, the actuator 202 is held with more force in its second position against the leading surface 72 on the base 40. The second clamping surface 154 remains at a constant distance from the first clamping surface 80 on the base 40. At a predetermined load, the webbing may slip and tend to balance the load on the torso portion 28 and lap portions 30 of the seat belt system 10.

When the vehicle occupant unbuckles the seat belt system 10, the tension on the lap portion 30 of the belt webbing 14 is released. The retractor 20 pulls on the torso portion 28 of the belt webbing 14 and winds belt webbing on the retractor 20. The tongue assembly 22 is pulled across the torso of the vehicle occupant until the tongue assembly 22 reaches the D-ring 24. If the tongue does not reach the D-ring before the system attains a stowed state, the tongue will remain on the webbing at the position it was released from the buckle. This occurs because of the friction inherent between the tongue and webbing.

When the tongue assembly 22 reaches the D-ring 24, the tongue assembly 22 is in a generally vertical position as illustrated in FIG. 1. The retractor 22 pulls belt webbing 14 through the tongue assembly 22 in the direction indicated by the arrow 222 in FIG. 6. The cam 140 rotates to the unlocked position shown in FIG. 6, and the cover 170 slides back to the position shown in FIG. 6. Because of the orientation of the inclined surfaces 86 of the teeth 82, the belt webbing 14 can run relatively freely through the tongue assembly 22 without encountering substantial resistance from the teeth 82. There is sufficient clearance for the belt webbing 14 to run relatively freely through the tongue assembly 22 between the clearance surface 152 on the cam 140 and the first clamping surface 80 on the base.

During the molding process in which the plastic body 44 is molded on the metal latch plate 42, locator pins retain the latch plate 42 in position in the mold. The plastic material of the plastic body 44 flows around the locator pins. After the molding process is completed, two openings 230 (FIG. 3) in the plastic body 44 remain where the locator pins were positioned against the latch plate 42. The openings extend from the surface of the plastic body 44 to the latch plate 42. Two similar locator pin openings (not shown) are on the lower side of the plastic body 44.

The foregoing description assumed that the seat belt system 10 (FIG. 1) is used for restraining a vehicle occupant in the seat 12. As noted above, the seat belt system 10 (FIG. 1) can also be used for restraining a child seat (not shown) in the seat 12. The seat belt system 10, when used for restraining a child seat in the seat 12, is buckled so that the lap portion 30 of the belt webbing 14 holds the child seat on the vehicle seat 12. The tongue assembly 22 clamps the seat belt webbing 14 so that the lap portion 30 of the belt webbing 14 can not be lengthened. Thus, the child seat is securely held in position on the vehicle seat 12. Accordingly, it can be seen that the present invention provides a tongue assembly for a seat belt system which is suitable for securing a child seat in position on a vehicle seat.

From the above description of the invention, those skilled in the art will perceive improvements, changes and modifications. Such improvements, changes and modifications within the skill of the art are intended to be covered by the appended claims.

We claim:

1. A tongue assembly for use in a safety apparatus in which belt webbing restrains movement of an occupant of a vehicle, said tongue assembly comprising:

a base having a latching portion for engagement with a buckle, a first clamping surface engageable by the belt webbing, and an opening through which the belt webbing extends;

a cover mounted on said base, said cover having an actuator portion engaged by the belt webbing upon tensioning of the belt webbing to move said cover on said base between a first position and a second position; and a clamping member mounted on said base, said clamping member having a second clamping surface disposed adjacent said first clamping surface on said base, the belt webbing passing between said first clamping surface on said base and said second clamping surface on said clamping member;

said clamping member being movable into a clamping position in which said second clamping surface on said clamping member clamps the belt webbing against said first clamping surface to block movement of the belt webbing through the tongue assembly in a first direction;

said cover having means for moving said clamping member into its clamping position to clamp the belt webbing when said cover moves from its first position to its second position.

2. A tongue assembly as defined in claim 1 wherein said clamping member comprises a cam mounted for pivotal movement on said base.

3. A tongue assembly as defined in claim 2 wherein said base comprises a latch plate and a plastic body portion molded on said latch plate, said plastic body portion having said first clamping surface thereon, said plastic body portion including a pair of cam support posts projecting upwardly from said first clamping surface for supporting said cam for pivotal movement on said base.

4. A tongue assembly as defined in claim 1 wherein said means for moving said clamping member relative to said cover comprises at least one rib depending from an inner wall surface of said cover and having a surface for engaging said clamping member to move said clamping member into its clamping position.

5. A tongue assembly as defined in claim 1 wherein said clamping member extends transversely across the belt webbing at a location spaced from said webbing opening in said base and the belt webbing is clamped between said first and second clamping surfaces at said location spaced from said webbing opening in said base.

6. A tongue assembly as defined in claim 5 wherein said base comprises a generally planar latch plate and said first and second clamping surfaces clamp the belt webbing between them in a direction transverse to the plane of said latch plate.

7. A tongue assembly for use in a safety apparatus in which belt webbing restrains movement of an occupant of a vehicle, said tongue assembly comprising:

a base having a latching portion for engagement with a buckle, a first clamping surface engageable by the belt webbing, and an opening through which the belt webbing extends;

a movable member mounted on said base said movable member having actuator means engageable by a first portion of the belt webbing for moving said movable member on said base between a first position and a second position; and a clamping member mounted on said base, said clamping member having a second clamping surface disposed adjacent said first clamping surface on said base, a second portion of the belt webbing passing between said first clamping surface on said base and said second clamping surface on said clamping member;

said clamping member being movable into a clamping position in which said second clamping surface on said clamping member clamps the second portion of the belt webbing against said first clamping surface at a location spaced from said opening to block movement of the belt webbing through the tongue assembly in a first direction; and said movable member having means for moving said clamping member into its clamping position when said movable member moves from its first position to its second position.

8. A tongue assembly as defined in claim 7 wherein said movable member comprises a cover for said tongue assembly having a top wall and opposite side walls, said actuator means being formed integrally with said top and side walls.

9. A tongue assembly as defined in claim 7 wherein said clamping member comprises a cam mounted for pivotal movement on said base.

10. A tongue assembly as defined in claim 7 wherein said first clamping surface on said base comprises a plurality of teeth having crests extending transversely across the belt webbing and oriented to resist movement of the belt webbing across said first clamping surface in said first direction to an extent greater than in a second direction opposite to said first direction.

11. A tongue assembly as defined in claim 7 wherein said base comprises a generally planar latch plate and said first and second clamping surfaces clamp the belt webbing between them in a direction transverse to the plane of said latch plate.

12. A tongue assembly for use in a safety apparatus in which belt webbing restrains movement of an occupant of a vehicle, said tongue assembly comprising:

a base having a latching portion for engagement with a buckle, a first clamping surface engageable by the belt webbing, and a webbing opening disposed intermediate said latching portion and said first clamping surface, a first portion of the belt webbing extending through said webbing opening;

a cover mounted on said base, said cover having an actuator portion disposed at least partially in said webbing opening in said base and engageable by the first portion of the belt webbing to slide said cover along said base between a first position and a second position; and a cam mounted on said base, said cam having a second clamping surface disposed adjacent said first clamping surface on said base, a second portion of the belt webbing passing between said first clamping surface on said base and said second clamping surface on said cam;

said cam being pivotable between a first position and a second position in which said second clamping surface on said cam clamps the second portion of the belt webbing against said first clamping surface to block movement of the belt webbing through the tongue assembly in a first direction;

said cover having a surface for engaging said cam when said cover slides from its first position to its second position;

said actuator portion of said cover being movable by the first portion of the belt webbing to slide said cover from its first position to its second position to pivot said cam from its first position to its second position to clamp the belt webbing.

13. A tongue assembly as defined in claim 12 wherein said cam is rotatable about an axis, said second clamping surface on said cam is spaced radially outwardly from said axis by a first distance, and said cam has a clearance surface spaced radially outwardly from said axis by a second distance which is less than said first distance, said clearance surface being generally parallel to and spaced from said first clamping surface on said base when said cover is in its first position.

14. A tongue assembly as defined in claim 12 wherein said base comprises a metal latch plate and a plastic body portion molded on said latch plate, said plastic body portion having said first clamping surface thereon, said first clamping surface on said base comprising a plurality of teeth for blocking movement of the belt webbing across said first clamping surface.

15. A tongue assembly as defined in claim 12 wherein said base comprises a generally planar latch plate and said first and second clamping surfaces clamp the belt webbing between them in a direction transverse to the plane of said latch plate.

* * * * *